US005907292A

United States Patent [19]

Ahr

[11] Patent Number: 5,907,292

[45] Date of Patent: May 25, 1999

[54] CIRCUIT FOR TRANSMITTING A MEASUREMENT CURRENT FROM AN INTRINSICALLY SAFE SENSOR TO A NON-INTRINSICALLY SAFE AREA

[75] Inventor: Robert Ahr, Marktoberdorf, Germany

[73] Assignee: Endress + Hauser Wetzer GmbH + Co. KG, Nesselwang, Germany

[21] Appl. No.: 08/883,518

[22] Filed: Jun. 26, 1997

[30] Foreign Application Priority Data

Jun. 28, 1996 [EP] European Pat. Off. ..... 96110541

[51] Int. Cl.[6] ..... G08C 19/06

[52] U.S. Cl. ..... 340/870.31; 340/870.39; 363/74

[58] Field of Search ..... 340/870.31, 870.39, 340/870.42; 363/22, 74; 374/183; 324/611

[56] References Cited

U.S. PATENT DOCUMENTS

| | | | |
|---|---|---|---|
| 3,764,880 | 10/1973 | Rose | 363/22 |
| 4,532,510 | 7/1985 | Bertrand | 340/870.31 |
| 4,725,839 | 2/1988 | Crowe | 340/870.31 |

FOREIGN PATENT DOCUMENTS

| | | |
|---|---|---|
| 27 01 184 | 7/1978 | Germany . |
| 3526997 A1 | 2/1986 | Germany . |
| 3812861 A1 | 10/1989 | Germany . |
| 620 537 A5 | 11/1980 | Switzerland . |

*Primary Examiner*—Michael Horabik
*Assistant Examiner*—Albert K. Wong
*Attorney, Agent, or Firm*—Bose McKinney & Evans

[57] ABSTRACT

This circuit arrangement comprises a transformer (2) for transmitting a measurement current (I), which is output by a sensor arrangement (1) at a measurement location situated in an intrinsically safe area (10), to a non-intrinsically safe area (20), in which a current measuring resistor (5) is situated. A DC converter (3) serves for the power supply of the sensor arrangement. A transformer (2) belongs to the DC converter (3), has a primary winding, which faces the non-intrinsically safe area, two identical partial windings (21, 22) connected in series in the same sense, and a single secondary winding (23), which faces the intrinsically safe area. A first end of the current measuring resistor (5) is connected to a circuit zero-point (SN) and a second end to a center tap of an output stage (31) of the DC converter (3). The center tap is connected to the input of an offset adjusting stage (6), an output of which is connected to the input of a voltage/current converter (7). A power source (4) is connected to the junction point of the partial windings (21, 22) and to the circuit zero-point.

2 Claims, 1 Drawing Sheet

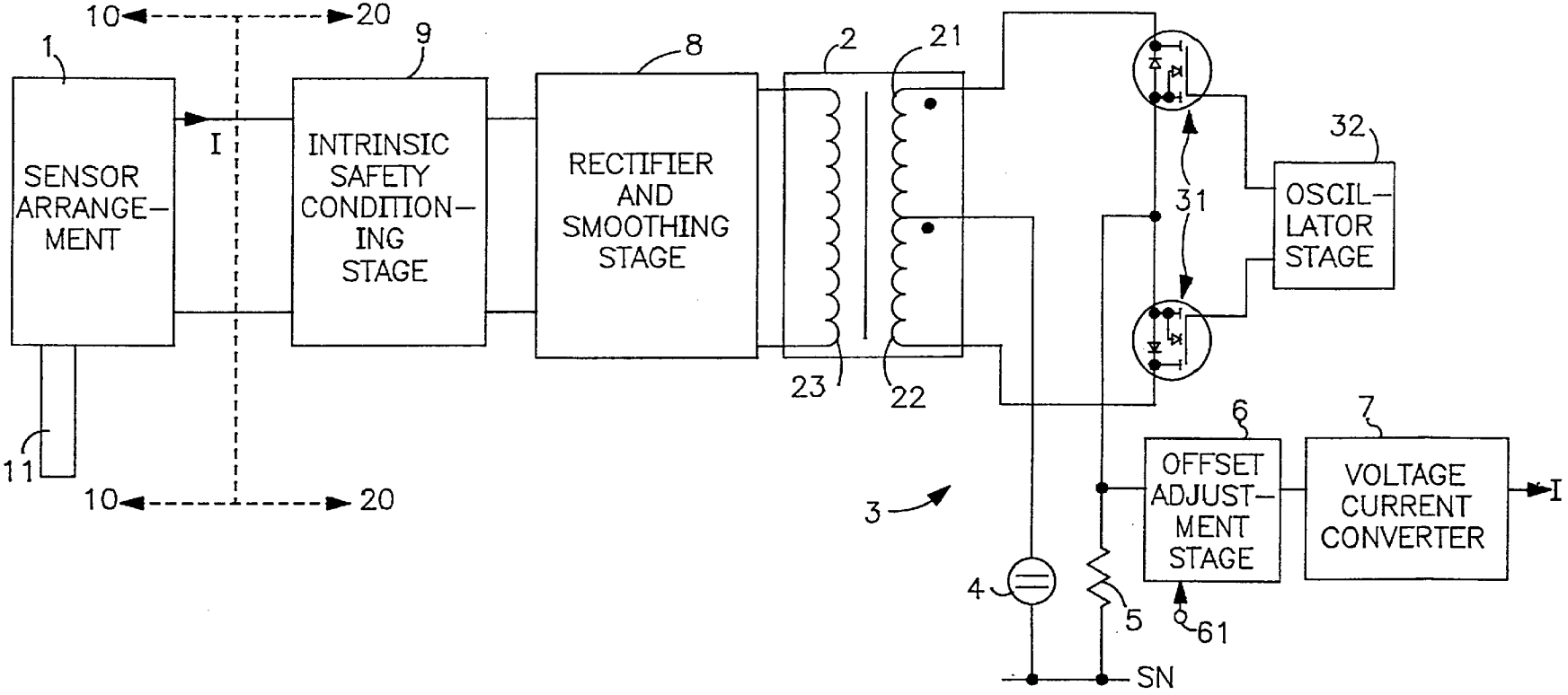
SENSOR ARRANGE-MENT
INTRINSIC SAFETY CONDITION-ING STAGE
RECTIFIER AND SMOOTHING STAGE
OSCIL-LATOR STAGE
OFFSET ADJUST-MENT STAGE
VOLTAGE CURRENT CONVERTER
I
SN
1
2
3
4
5
6
7
8
9
10
11
20
21
22
23
31
32
61

CIRCUIT FOR TRANSMITTING A MEASUREMENT CURRENT FROM AN INTRINSICALLY SAFE SENSOR TO A NON-INTRINSICALLY SAFE AREA

FIELD OF THE INVENTION

The invention relates to a circuit arrangement for transmitting a measurement current from an intrinsically safe sensor arrangement to a non-intrinsically safe area by means of a current measuring resistor situated in the latter.

BACKGROUND OF THE INVENTION

According to an industrial metrology standard which has existed for a long time, electrical signals which are output by sensors and which are generated by the sensors on the basis of a physical or chemical law are converted into a measurement current, corresponding to the measurement range of a sensor, of 4 mA to 20 mA. The sensor is often augmented by a conversion stage, which is provided for this and is structurally combined with the sensor, and forms a sensor arrangement.

The measurement current can, on the one hand, be conducted via a transmission line, for example via a two-wire line, to a suitable display location, for example to a central measurement control station. On the other hand, power is supplied to the sensor arrangement via the transmission line.

In the latter context, DE-A 27 01 184 describes a circuit arrangement which serves for transmitting a measurement current, which is output by a sensor arrangement at a measurement location, to a current measuring resistor, which is situated at a distance therefrom, in conjunction with simultaneous power supply of the sensor arrangement via the current measuring resistor, which is connected in series with a power source, by means of a two-wire line.

Furthermore, DE-A 35 26 997 describes a circuit arrangement which serves for transmitting a measurement-current of 0 mA to 20 mA generated in a first circuit to a second circuit by means of a transformer, which belongs to a DC converter used for the power supply of the first circuit and situated on the side of the latter, the transformer having, on the side of the second circuit, two series-connected partial windings, to whose junction point a first pole of a power source is connected and to whose terminals which are remote from the junction point a second pole of the power source is connected.

Finally, DE-A 38 12 861 describes a circuit arrangement for intrinsically safe power supply from a non-intrinsically safe area by means of a DC converter situated in this area, to which DC converter a push-pull transformer belongs, which has a primary winding, which faces the non-intrinsically safe area and has two partial windings connected in series in opposite senses, and a secondary winding, which faces the intrinsically safe area and has two identical partial windings connected in series in opposite senses.

SUMMARY OF THE INVENTION

An object of the invention consists in providing a circuit arrangement for transmitting a measurement current, which is output by a sensor arrangement at a measurement location situated in an intrinsically safe area, to a non-intrinsically safe area by means of a current measuring resistor, which is situated in the latter, in conjunction with simultaneous power supply of the sensor arrangement from the non-intrinsically safe area by means of a DC converter.

In order to achieve this object, the invention consists in a circuit arrangement for transmitting a measurement current, which is output by a sensor arrangement at a measurement location situated in an intrinsically safe area, via a transformer to a non-intrinsically safe area by means of a current measuring resistor, which is situated in the latter, in conjunction with simultaneous power supply of the sensor arrangement by means of a DC converter, to which the transformer belongs, which has a primary winding, which faces the non-intrinsically safe area and has two identical partial windings connected in series in the same sense, and a single secondary winding, which faces the intrinsically safe area, in which circuit arrangement

- a first end of the current measuring resistor is connected to a circuit zero-point and a second end of the current measuring resistor is connected to a center tap of an output stage of the DC converter, the center tap is connected to the input of an offset adjusting stage,
- an output of the offset adjusting stage is connected to the input of a voltage/current converter, and a first pole of a power source is connected to the junction point of the partial windings and a second pole of the power source is connected to the circuit zero-point.

One advantage of the invention consists in the fact that the effect of the no-load losses on the proportionality of the transmitted measurement current can be minimized by means of the offset adjusting stage.

BRIEF DESCRIPTION OF THE DRAWINGS

The invention and further advantages will now be explained in more detail using an exemplary embodiment which is illustrated in the FIGURE of the drawing.

DETAILED DESCRIPTION OF THE DRAWING

The block diagram of the FIGURE shows a circuit arrangement for transmitting a measurement current I, which is output by a sensor arrangement 1 having a sensor 11, via a transformer 2. The sensor arrangement 1 having the sensor 11, that is to say a measurement location or point, is in this case situated in an intrinsically safe area 10, as is indicated by the two arrows pointing to the left. The conditions for an intrinsically safe area are defined, for example, in the European Standards EN 50014 to EN 50039.

The sensor 11 converts a physical measured quantity such as, for example, a pressure, a temperature, a flow rate, a filling level, a pH-value, a redox potential, a gas concentration, a moisture concentration, etc. into a corresponding electrical quantity such as, for example, a current or a voltage. The sensor arrangement 1 then generates from this current or from this voltage the measurement current I which is proportional thereto and which can encompass the standard range, mentioned in the introduction, of 4 mA to 20 mA.

The transformer 2 is situated, together with further components and circuit elements still to be described, in a non-intrinsically safe area 20, as is indicated by the arrows pointing to the right. The transformer 2 belongs to a DC converter 3, which has a primary winding, which faces the non-intrinsically safe area 20 and has two identical partial windings 21, 22 connected in series in the same sense, and a single secondary winding 23, which faces the intrinsically safe area 10.

The DC converter 3 furthermore comprises an output stage 31, which, in the exemplary embodiment of the FIGURE, is a push-pull output stage having two MOS power transistors connected in series by their controlled current paths, and an oscillator stage 32, which preferably generates squarewave pulses for driving the output stage 31.

The output stage 31 is supplied by a power source 4, of which a first pole is connected to the junction point of the two partial windings 21, 22 and a second pole is connected to a circuit zero-point SN, which belongs to the non-intrinsically safe area 20.

A first end of a current measuring resistor 5 is connected to the circuit zero-point SN and a second end of the current measuring resistor is connected to a center tap of the output stage 31. The input of an offset adjusting stage 6 is connected to this center tap and, consequently, also to the second end, remote from the circuit zero-point SN, of the current measuring resistor 5. The output of said offset adjusting stage is connected to the input of a voltage/current converter 7, at whose output the measurement current I can be picked off.

The offset adjusting stage 6 is supplied with a corresponding adjusting signal and serves mainly for the correction or compensation of no-load losses of the transformer 2; the corresponding current flows through the current measuring resistor 5 as no-load current together with a current transmitted from the secondary side of the transformer 2 and proportional to the measurement current I. Consequently, however, the voltage drop across the measuring resistor 5 is not proportional to the measurement current I. The offset adjusting stage 6 is preferably realized by means of an operational amplifier, whose gain is rendered variable by means of a potentiometer.

The secondary side of the transformer 2 feeds a rectifier and smoothing stage 8 and this, in turn, an intrinsic safety conditioning stage 9. The latter contains those components which, in accordance with the above-mentioned standards, permit the maximum voltage and current values prescribed in the latter to be adhered to. These components are, in particular, series resistors in each of the supply lines to the sensor arrangement 1 and protective diodes, for example Zener diodes, connected in parallel therewith.

I claim:

1. A circuit arrangement for transmitting a measurement current, which is output by a sensor arrangement at a measurement location situated in an intrinsically safe area, to a current measuring resistor situated in a non-intrinsically safe area and for simultaneously supplying power to the sensor arrangement, said circuit arrangement comprising:

a DC converter which supplies power to the sensor arrangement, the DC converter including a transformer and an output stage, the transformer having a primary winding and a secondary winding, the primary winding facing the non-intrinsically safe area and having two identical partial windings connected in series in the same sense, the secondary winding facing the intrinsically safe area and being a single winding, the current measuring resistor having a first end connected to a circuit zero-point and a second end connected to a center tap of the output stage of the DC converter, a voltage/current converter, an offset adjusting stage having an input connected to the center tap of the output stage of the DC converter and an output connected to an input of the voltage/current converter, and a power source having a first pole connected to the junction point of the partial windings of the transformer and a second pole connected to the circuit zero-point.

2. A circuit coupled to a sensor located in an intrinsically safe area, comprising:

a circuit zero-point node;

a power source having a first pole and a second pole, said second pole being connected to said circuit zero-point node;

a rectifier having a first pair of terminals and a second pair of terminals, said first pair of terminals being coupled to said sensor;

a transformer having a primary winding and a secondary winding, wherein said primary winding includes two serially connected partial windings with a junction point located between the two serially connected partial windings and two end taps respectively located at opposing ends of said primary winding, said junction point being electrically connected to said first pole of said power source, and wherein the secondary winding is coupled to said second pair of terminals of said rectifier;

a push-pull transistor circuit having a pair of outputs coupled respectively to said two end taps of said primary winding, said push-pull transistor circuit having a first transistor and a second transistor interconnected to form a common node, and wherein each of said first transistor and said second transistor includes a control input;

an oscillator coupled to said control input of each of said first transistor and said second transistor;

a current measuring resistor having a first lead coupled to said common node of said push-pull transistor circuit and having a second lead connected to said circuit zero-point node; and an offset adjusting stage connected to said common node of said push-pull transistor circuit and to said first lead of said current measuring resistor.

* * * * *